US011889971B2

(12) United States Patent
Lin et al.

(10) Patent No.: US 11,889,971 B2
(45) Date of Patent: Feb. 6, 2024

(54) CLEANING ROBOT, BRISTLE CONTROL METHOD AND DEVICE, AND COMPUTER STORAGE MEDIUM

(71) Applicants: YUNJING INTELLIGENCE (SHENZHEN) CO., LTD., Shenzhen (CN); YUNJING INTELLIGENCE INNOVATION (SHENZHEN) CO., LTD., Shenzhen (CN)

(72) Inventors: Weijing Lin, Shenzhen (CN); Yun Chen, Shenzhen (CN); Minzhao Xie, Shenzhen (CN)

(73) Assignees: YUNJING INTELLIGENCE (SHENZHEN) CO., LTD., Shenzhen (CN); YUNJING INTELLIGENCE INNOVATION (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 18/344,890

(22) Filed: Jun. 30, 2023

(65) Prior Publication Data

US 2023/0355064 A1 Nov. 9, 2023

Related U.S. Application Data

(63) Continuation of application No. PCT/CN2022/119132, filed on Sep. 15, 2022.

(30) Foreign Application Priority Data

Sep. 23, 2021 (CN) ..... 202111114331.4
Sep. 23, 2021 (CN) ..... 202111116086.0

(51) Int. Cl.
*A47L 9/28* (2006.01)
*A47L 9/04* (2006.01)
*A47L 9/00* (2006.01)

(52) U.S. Cl.
CPC ..... *A47L 9/2847* (2013.01); *A47L 9/0466* (2013.01); *A47L 9/2805* (2013.01); *A47L 9/009* (2013.01); *A47L 2201/06* (2013.01)

(58) Field of Classification Search
CPC .... A47L 9/2847; A47L 9/0466; A47L 9/2805; A47L 9/009; A47L 2201/06
See application file for complete search history.

(56) References Cited

U.S. PATENT DOCUMENTS

2013/0291331 A1* 11/2013 Yang ..... A47L 9/0472 15/383
2018/0242807 A1* 8/2018 Lee ..... B25J 9/16
2021/0386262 A1* 12/2021 Uchendu ..... G05D 1/0044

FOREIGN PATENT DOCUMENTS

AU 2012310377 A1 9/2013
CN 103402412 A 11/2013
(Continued)

*Primary Examiner* — Marc Carlson

(57) ABSTRACT

A cleaning robot, a bristle control method and a bristle control device, and a computer storage medium are provided. The cleaning robot includes a robot body, an side brush assembly disposed on the robot body, and a controller disposed on the robot body and configured to control a target bristle of the side brush assembly to be limited in a designated area. In embodiments of this application, the target bristle of the side brush assembly is limited in the designated area to prevent, as much as possible, the target bristle from exceeding out of the cleaning robot and affecting the appearance of the cleaning robot.

17 Claims, 6 Drawing Sheets

(56) References Cited

FOREIGN PATENT DOCUMENTS

| | | | | | |
|---|---|---|---|---|---|
| CN | 103741618 | A | | 4/2014 | |
| CN | 205144441 | U | | 4/2016 | |
| CN | 106691313 | A | * | 5/2017 | |
| CN | 207041491 | U | | 2/2018 | |
| CN | 108742326 | A | | 11/2018 | |
| CN | 109259674 | A | | 1/2019 | |
| CN | 109645896 | A | | 4/2019 | |
| CN | 208933886 | U | | 6/2019 | |
| CN | 106227214 | B | | 8/2019 | |
| CN | 110547733 | A | | 12/2019 | |
| CN | 110868897 | A | | 3/2020 | |
| CN | 210204620 | U | | 3/2020 | |
| CN | 210228029 | U | | 4/2020 | |
| CN | 210277064 | U | | 4/2020 | |
| CN | 210643925 | U | | 6/2020 | |
| CN | 111493755 | A | | 8/2020 | |
| CN | 211212939 | U | | 8/2020 | |
| CN | 111728536 | A | * | 10/2020 | |
| CN | 112120605 | A | | 12/2020 | |
| CN | 113116246 | A | * | 7/2021 | ..... A47L 11/284 |
| CN | 113197518 | A | | 8/2021 | |
| CN | 113261887 | A | | 8/2021 | |
| CN | 113558528 | A | * | 10/2021 | |
| CN | 113974505 | A | * | 1/2022 | |
| CN | 113974506 | A | * | 1/2022 | ..... A47L 11/28 |
| CN | 114098524 | A | * | 3/2022 | |
| CN | 114617481 | A | * | 6/2022 | |
| CN | 115462703 | A | * | 12/2022 | |
| EP | 2737837 | A2 | | 6/2014 | |
| JP | 2003038402 | A | | 2/2003 | |
| JP | 2016182300 | A | | 10/2016 | |
| KR | 100962121 | B1 | | 6/2010 | |
| WO | 2013042975 | A2 | | 3/2013 | |
| WO | WO-2015163373 | A1 | * | 10/2015 | ..... A47L 11/4038 |
| WO | WO-2021136023 | A1 | * | 7/2021 | ..... A47L 11/284 |

* cited by examiner

CLEANING ROBOT, BRISTLE CONTROL METHOD AND DEVICE, AND COMPUTER STORAGE MEDIUM

CROSS REFERENCE TO RELATED APPLICATIONS

The present application claims benefit of Chinese Patent Applications 202111114331.4 and 202111116086.0, both filed on Sept. 23, 2021.

TECHNICAL FIELD

The present application relates to the technical field of robots, in particular to a cleaning robot, a bristle control method, a bristle control device, and a computer storage medium.

BACKGROUND

With the rapid development of intelligent equipment technology, the cleaning robot with the automatic cleaning function becomes increasingly popular. Meanwhile, as the life rhythm of people is accelerated, the cleaning robot becomes more important for a family. The cleaning robot may automatically perform a cleaning operation in a cleaning space to be cleaned such as a home space or a large place, so as to save a lot of time for the user.

A cleaning assembly and a driving device are provided on the robot body of the cleaning robot. Driven by the driving device, the cleaning robot performs self-moving according to a preset cleaning path, and cleans the ground surface through the cleaning assembly.

For the multifunctional cleaning robot, the cleaning assembly may include both a side brush assembly and a mopping assembly. The side brush assembly is usually mounted in the front of the bottom of the robot body, and the mopping assembly is usually mounted at the rear of the bottom of the robot body. The mopping assembly includes one mop or more than one mops, which can be rotated or moved to implement the mopping function.

In the related art, when the side brush assembly is not in work (for example, in the mopping mode), the bristles of the side brush assembly rotate along with movement of the robot, which often has adverse effects on such as external things outside the cleaning robot or the mopping assembly, the driving wheel, and the like inside the cleaning robot.

For example, during the travelling process of the cleaning robot in the mopping mode, the bristles, which exceed out of the cleaning robot, affect the appearance, thus the user experience is also affected.

SUMMARY

A first aspect of the embodiments of this application provides a cleaning robot, which includes:

- a robot body;
- a side brush assembly disposed on the robot body;
- a controller disposed on the robot body and configured for controlling a target bristle of the side brush assembly to be limited in a designated area;
- where the designated area is a projection area of the robot body on a horizontal plane,
- the target bristle has a length greater than a preset length threshold, and the preset length threshold is a minimum distance between a rotation center of the side brush and an edge of the robot body.

A second aspect of the embodiments of this application provides a bristle control method applied to the cleaning robot as described above. The cleaning robot includes a side brush assembly, and the method includes:

- controlling the target bristle of the side brush assembly to be limited in the designated area,
- where the designated area is the projection area of the robot body on the horizontal plane,
- the target bristle has the length greater than the preset length threshold, and the preset length threshold is the minimum distance between the rotation center of the side brush and the edge of the robot body.

A third aspect of the embodiments of the present application provides a bristle control device applied to the cleaning robot as described above. The cleaning robot includes a side brush assembly, and the bristle control device includes:

- a controller configured for controlling the target bristle of the side brush assembly to be limited in the designated area,
- where the designated area is the projection area of the robot body on the horizontal plane,
- the target bristle has the length greater than the preset length threshold, and the preset length threshold is the minimum distance between the rotation center of the side brush and the edge of the robot body.

A fourth aspect of the embodiments of this application provides a cleaning robot, which includes:

- a robot body;
- an side brush assembly and a mopping assembly disposed on the robot body;
- a controller disposed on the robot body and configured for:
  - controlling a target bristle of the side brush assembly to be limited in a designated area; or
  - controlling a target bristle outside a designated area to be separated from a ground,
- where the designated area is an area formed by two tangent lines of a mopping area formed by the mopping assembly along a travelling direction of the cleaning robot,
- the target bristle has a length greater than a preset length threshold, and the preset length threshold is a minimum distance between a rotation center of the side brush and the two tangent lines.

A fifth aspect of the embodiments of this application provides a bristle control method applied to the cleaning robot as described above. The robot body includes a side brush assembly and a mopping assembly both disposed on the robot body, and the method includes:

- controlling the target bristle of the side brush assembly to be limited in the designated area; or
- controlling the target bristle outside the designated area to be separated from the ground,
- where the designated area is the area formed by the two tangent lines of the mopping area formed by the mopping assembly along the travelling direction of the cleaning robot,
- the target bristle has the length greater than the preset length threshold, and the preset length threshold is the minimum distance between the rotation center of the side brush and the two tangent lines.

A sixth aspect of the embodiments of this application provides a bristle control device applied to the cleaning robot as described above. The robot body includes a side brush assembly and a mopping assembly both disposed on the robot body, and the bristle control device includes:

a controller configured for:

controlling the target bristle of the side brush assembly to be limited in the designated area; or controlling the target bristle outside the designated area to be separated from the ground, where the designated area is the area formed by the two tangent lines of the mopping area formed by the mopping assembly along the travelling direction of the cleaning robot, the target bristle has the length greater than the preset length threshold, and the preset length threshold is the minimum distance between the rotation center of the side brush and the two tangent lines.

A seventh aspect of the embodiments of this application provides a computer-readable storage medium including an instruction, and the instruction, when executed by a computer, causes the computer to execute the bristle control method as described above.

In embodiments of this application, a target bristle, which has a length greater than a preset length threshold, may exceeds out of the designated area, the preset length threshold is the minimum distance between the rotation center of the side brush and the tangent line. The area outside the designated area which is polluted by the target bristle during the moving of the cleaning robot, cannot be cleaned by the mopping assembly timely. Therefore, the target bristle of the side brush assembly can be limited in the designated area or the target bristle outside the designated area can be controlled to be separated from the ground, so that the clean surface can be prevented, as much as possible, from being touched and polluted by the target bristle which exceeds out of the designated area.

BRIEF DESCRIPTION OF THE DRAWINGS

In order to clearly illustrate the embodiments of this application or the technical solutions of the related art, the drawings required for the description of the embodiments or the related art will be briefly introduced below. Obviously, the drawings in the following description are merely some embodiments of the present application. Those skilled in the art can obtain other drawings based on these drawings without creative efforts.

DETAILED DESCRIPTION OF THE EMBODIMENTS

Figure 1:
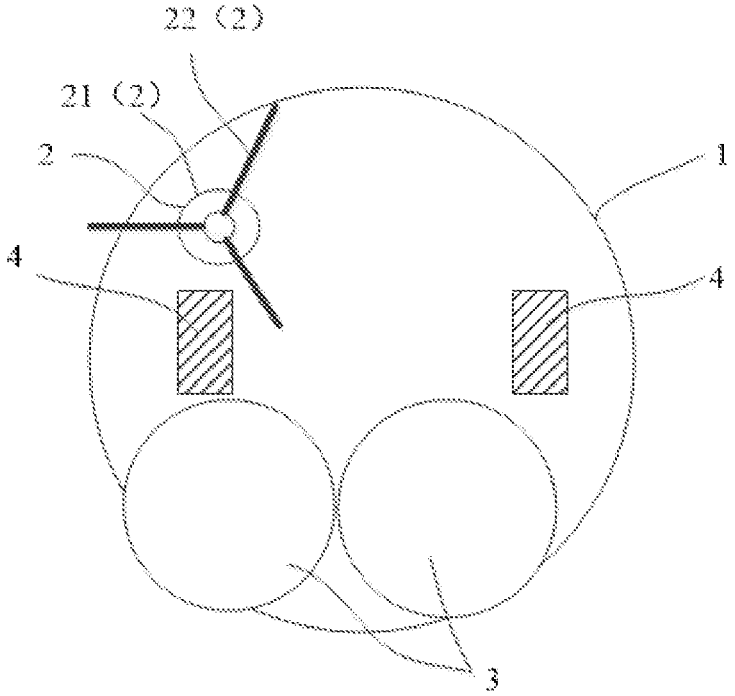
FIG. 1 is a structural diagram of a cleaning robot according to an embodiment of this application.

In order to make the objectives, features, and advantages of the present application more apparent and understandable, the embodiments of this application will be clearly and completely described below with reference to the accompanying drawings of the embodiments of this application. Obviously, the embodiments described below are merely a part of the embodiments of this application, not all of the embodiments. All other embodiments obtained by those skilled in the art based on the embodiments of the present application without creative efforts shall fall within the scope of the present application.

The cleaning robot can be used to automatically clean the ground surface, and the application scenario can be cleaning a home space, a large place or the like.

Cleaning robots of various types include sweeping robots, mopping robots, sweeping and mopping integrated robots, and the like. The cleaning robot is provided with a cleaning assembly and a driving device. Driven by the driving device, the cleaning robot moves along a preset cleaning path, and cleans the ground through the cleaning assembly. For a sweeping robot, the cleaning assembly includes a sweeping assembly and a dust suction device, during the cleaning process, the sweeping assembly sweeps dust, garbage and the like to a dust suction port of the dust suction device, so that the dust suction device receives the dust, garbage and the like for storage, and the sweeping assembly may include a side brush assembly. For a mopping robot, the cleaning assembly includes a mopping assembly which is in contact with the ground, and mops and cleans the ground during the travelling process of the mopping robot. For a sweeping and mopping integrated cleaning robot, the cleaning assembly includes a sweeping assembly and a mopping assembly which may work together to mop and sweep, or may work separately to either mop or sweep. The sweeping assembly may further include a side brush assembly and a rolling brush (also referred to as a middle brush). The side brush assembly sweeps garbage such as dust from an outer side to a middle area, and the rolling brush sweeps the garbage to the dust suction device.

The inventors, through their creative endeavor, have found that in the related art, when the side brush assembly is not in work (for example, in a mopping mode), the bristles of the side brush assembly rotate with the movement of the robot, which often has adverse effects on such as external things outside the cleaning robot or the mopping assembly, the driving wheel and the like inside the cleaning robot.

For example, during the travelling process of the cleaning robot in the mopping mode, the bristles, which often exceeds out of a cleanable range of the mop, cause pollution to nearby cleaned areas.

Based on this, some embodiments of the present application provide a cleaning robot, which may limit a target bristle of the side brush assembly to a designated area, or control the target bristle outside the designated area to be separated from the ground, so as to avoid, as much as possible, contamination of clean surfaces due to that the target bristle exceeds out of the designated area and touches the clean surfaces.

The following describes in detail through embodiments.

In some embodiments, as shown in FIG. 1, the cleaning robot may include a robot body 1, a side brush assembly 2, a mopping assembly 3, driving wheels 4, and a controller.

The side brush assembly 2 and the mopping assembly 3 are arranged on the robot body 1, and the side brush assembly 2 includes bristles 22. The controller is arranged on the robot body 1 and configured for controlling a target bristle of the side brush assembly to be limited in a designated area; or, controlling a target bristle outside a designated area to be separated from the ground.

The designated area is formed by two tangent lines of a mopping area formed by the mopping assembly, and the two tangent lines are exceeded along a travelling direction of the cleaning robot.

The target bristle has a length greater than a preset length threshold, and the preset length threshold is the minimum distance between a rotation center of the side brush (i.e. rotation center of the side brush assembly) and the tangent lines.

The side brush assembly 2 may further include an output shaft 21, and the bristles 22 are mounted on the robot body 1 by taking the output shaft 21 as a rotating shaft, and the side brush assembly is configured for sweeping the ground.

Optionally, in addition to the target bristle having a length greater than the preset length threshold, the side brush assembly may further include non-target bristles having other lengths, which is not limited in the present application.

Optionally, there may be one or more side brush assemblies 2, and the side brush assemblies 2 are spaced at a bottom or a periphery of the robot body 1. The bristles 22 included in each side brush assembly 2 may be one or more. One end of each bristle 22 is connected to the output shaft 21, and the other end of each bristle 22 is free, so that the bristles 22 can be driven to rotate with respect to the robot body 1 by taking the output shaft 21 as a rotating shaft.

When there are two or more bristles 22, the bristles 22 are distributed at intervals around the periphery of the output shaft 21, and the bristles 22 may be or may not be evenly distributed, which is not limited in the present application. When the side brush assembly 2 is in a working state, the driving device drives the bristles of the side brush assembly to rotate to realize a sweeping function.

Figure 2:
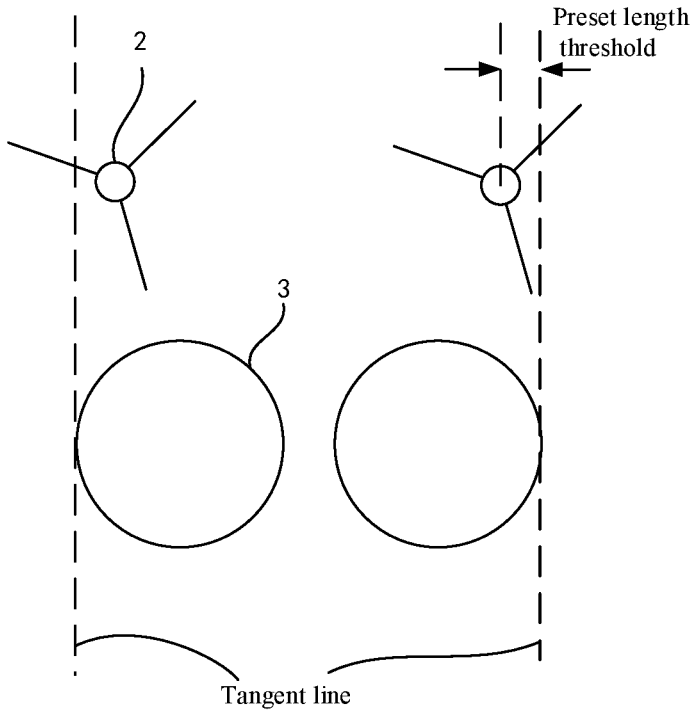
FIG. 2 is a schematic diagram of a side brush assembly and a mopping assembly according to an embodiment of this application.

As shown in FIG. 2, the designated area is formed by and located between two tangent lines of the mopping area of the mopping assembly along the travelling direction of the cleaning robot. In a specific implementation, during the movement process of the cleaning robot, the side brush assembly is located in front of the mopping assembly. The area within the designated area, which has been touched by the side brush assembly, can be cleaned by the mopping assembly timely. However, when the target bristle of the side brush assembly exceeds out of the designated area, the area outside the designated area may be polluted by the target bristle. Therefore, the target bristle of the side brush assembly can be controlled to be limited in the designated area, or the target bristle outside the designated area can be controlled to be separated from the ground, so that the target bristle of the side brush assembly is prevented, as much as possible, from exceeding out of the designated area to pollute the clean surface.

In some embodiments of this application, the length of the target bristle is greater than a preset length threshold, and the preset length threshold is equal to the minimum distance between the rotation center of the side brush and the tangent line. The target bristle may exceed out of the designated area, and when the cleaning robot moves, the ground surface polluted by the target bristle out of the designated area cannot be immediately cleaned by the mopping assembly. Therefore, the target bristle of the side brush assembly can be limited in the designated area, or the target bristle outside the designated area can be controlled to be separated from the ground, to avoid, as much as possible, that the target bristle exceeds out of the designated area, touches and pollutes the clean surface.

Optionally, the designated area includes a designated sub-area, and the designated sub-area is an area where the designated area overlaps with a horizontal projection area of the robot body.

The target bristle exceeds out of the horizontal projection area of the robot body, which will cause the side brush be seen by the user, which is not attractive enough, and affects the user experience. Therefore, the target bristle can be controlled to be limited in the designated sub-area, so as not to pollute the area outside the designated area, and not to exceed out of the horizontal projection area of the robot body to affect the appearance.

Figure 3:
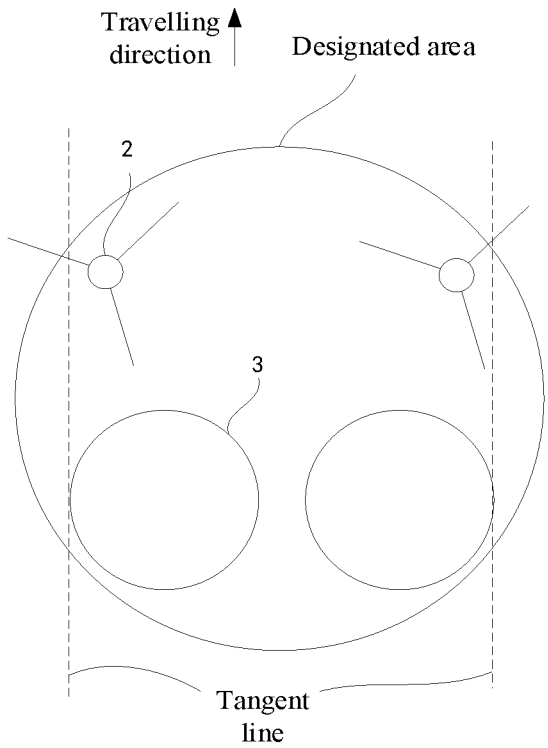
FIG. 3 is a schematic diagram of an area where a designated area overlaps with a horizontal projection area of a robot body according to an embodiment of this application.

As shown in FIG. 3, the designated area is formed by and located between two tangent lines of the mopping area formed by the mopping assembly along the travelling direction of the cleaning robot, and the designated sub-area is an area where the designated area overlaps with the horizontal projection area of the robot body.

Optionally, the designated area includes the designated sub-area, and regarding the controlling the target bristle of the side brush assembly to be limited in the designated area, the controller is configured for:

controlling the target bristle to rotate or translate to be limited in the designated area or the designated sub-area.

The target bristle is controlled to rotate or translate, so that the target bristle is limited in the designated area or in the designated sub-area. By controlling the target bristle to be limited in the designated sub-area, the target bristle will neither pollute the area outside the designated area, nor exceed out of the horizontal projection area of the robot body to affect the appearance.

The side brush assembly can be rotated, so that target bristle is rotated to the designated area or the designated sub-area. In a specific implementation, after the target bristle is controlled to rotate to the designated area or the designated sub-area, the target bristle can be limited in the designated area or the designated sub-area, and no longer exceed out of the designated area or the designated sub-area. For example, the target bristle can be controlled to rotate to the designated area or the designated sub-area, and then the target bristle can be fixed in the designated area or the designated sub-area, or the target bristle is controlled to be within the designated area or the designated sub-area, and will not rotate out of the designated area or the designated sub-area.

The side brush assembly can also be controlled to translate. Specifically, the side brush assembly can be controlled to translate towards the inner side of the designated area or the designated sub-area, so that the target bristle is moved to be within the designated area or the designated sub-area.

Figure 4:
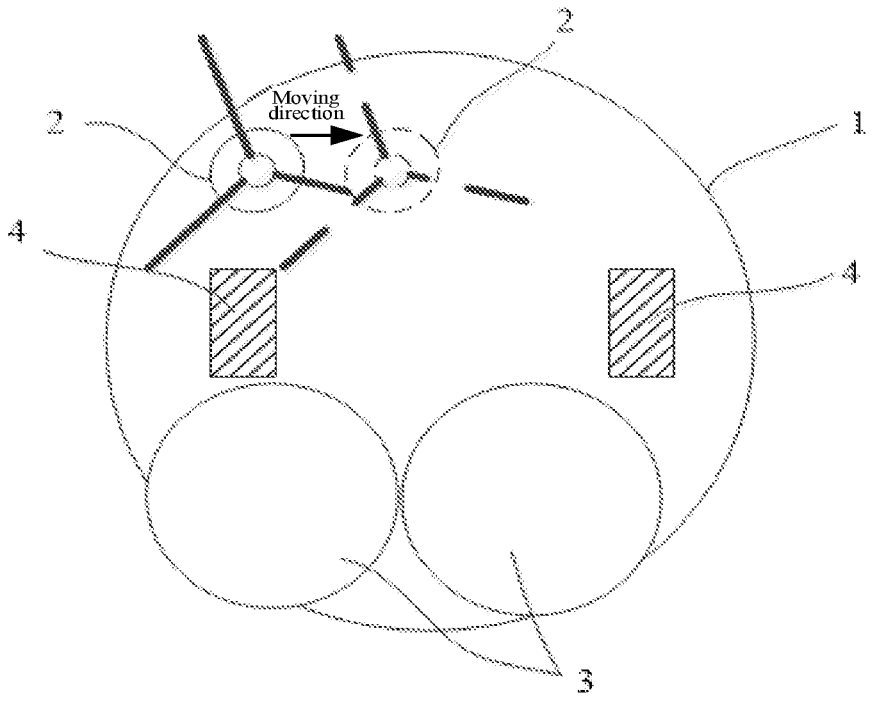
FIG. 4 is a schematic structural diagram showing the side brush assembly before and after a movement according to an embodiment of this application.

As shown in FIG. 4, after the whole of the side brush assembly 2 moves towards the inner side of the robot body 1, the whole of the side brush assembly 2 is moved closer to a central position of the robot body 1, thus the target bristle of the side brush assembly is also moved to the designated area or the designated sub-area. The area in the designated area or the designated sub-area, which has been traversed by the bristles, can be cleaned by the mopping assembly behind, thus the risk of contamination of the cleaned area by the side brush assembly 2 due to the target bristle exceeding out of the designated area is reduced, and the affect of the target bristle of the side brush assembly exceeding out of the designated sub-area on the appearance is avoided as much as it can.

Optionally, the designated area or the designated sub-area does not include where the driving wheels 4 are located.

Generally, the driving wheels 4 of the driving device are arranged at the middle position of the bottom of the robot body 1 and close to the side brush assembly 2. If the length of the bristle of the side brush assembly 2 is greater than the spacing between the side brush assembly 2 and the driving wheels 4, the bristles 22 may be pinned by the driving wheel 4 and damaged. For this purpose, in some embodiments of this application, the designated area does not include where the driving wheels 4 are located, so that the positions where the driving wheel 4 are located are excluded from the designated area, and the situation that the bristles 22 are pinned by the driving wheel 4 is avoided as much as it can.

When the side brush assembly 2 includes a plurality of bristles 22 having different lengths, the long bristle having a length greater than the preset length threshold may be taken as target bristles. As shown in FIG. 2, when the mopping assembly is in work, a mopping area is formed, and the preset length threshold may be set to be equal to the minimum distance between the rotation center of the side brush and the tangent lines, thereby the target bristles will not exceed out of the designated area during the travelling process of the cleaning robot. It may be understood that the target bristles having lengths greater than the preset length threshold may exceed out to an area other than the designated region, and cause contamination, thus, the target bristles can be limited to the designated area while whether other bristles is limited in the designated area is not required.

In an embodiment of this application, when only one target bristle has a length greater than the preset length threshold, the cleaning robot can control this target bristle to be in the designated area or in the designated sub-area.

When there is more than one target bristles (i.e., the bristles having lengths greater than the preset length threshold), and an included angle between two target bristles is larger, there may be a situation that one target bristle is limited to the designated area or the designated sub-area, but the other target bristle is located outside the designated area or the designated sub-area and pollutes the area outside the designated area when it is outside of the designated area or affects the appearance when it is outside of the designated sub-area. Thus, in order to alleviate the undesirable effects brought by the target bristle as much as possible, a target included angle between two target bristles which have the maximum distance therebetween may be set to be less than or equal to a reference angle threshold, so that the target bristles which have the maximum distance therebetween are both limited in the designated area or the designated sub-area, and the bristles between these two target bristles are all limited in the designated area or the designated sub-area. Therefore, during the travelling process of the cleaning robot, all target bristles will not exceed out of the designated area or the designated sub-area. In this way, the controller can control all the target bristles to be limited in the designated area or the designated sub-area at the same time.

Optionally, the number of the target bristles is at least two, and a target included angle between two target bristles having the maximum distance therebetween is less than or equal to a reference angle threshold.

In a possible implementation, the designated sub-area includes a first contour point and a second contour point. A distance between the first contour point and the rotation center of the side brush assembly and a distance between the second contour point and the rotation center of the side brush assembly are both equal to the length of the target bristle, and the reference angle threshold refers to an included angle between a first connecting line from the first contour point to the rotation center and a second connecting line from the second contour point to the rotation center.

Figure 5:
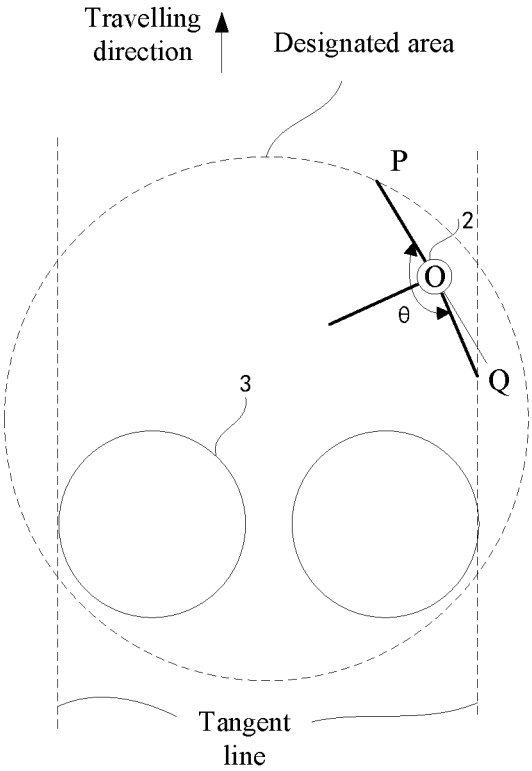
FIG. 5 is a schematic diagram of determining a reference angle threshold according to a designated sub-area according to an embodiment of this application.

As shown in FIG. 5, the designated sub-area is an area where the designated area overlaps with the horizontal projection area of the robot body. The designated sub-area includes a first contour point P and a second contour point Q. The first contour point P is a point on a contour of the robot body, and the second contour point Q is a point on a tangent line. A distance between the first contour point P and the rotation center O of the side brush assembly and a distance between the second contour point P and the rotation center O of the side brush assembly are both equal to a length L of the target bristle. At this time, the reference angle threshold refers to the angle θ between a first connecting line from the first contour point P to the rotation center O and a second connecting line from the second contour point Q to the rotation center O.

By controlling the target included angle between two target bristles which are farthest to each other to be less than the reference angle threshold, all the target bristles can be limited to the designated sub-area. When the target bristles rotate, the target bristles will not exceed out of the designated sub-area, thus the target bristles can be prevented from causing pollution as much as possible, and the effect of the target bristles on the appearance can be avoided as much as possible.

In another possible implementation, a tangent line includes a first target point and a second target point. A distance between the first target point and the rotation center of the side brush assembly and a distance between the second target point and the rotation center of the side brush assembly are both equal to the length of the target bristle, and the reference angle threshold refers to an included angle between a third connecting line from the first target point to the rotation center and a fourth connecting line from the second target point to the rotation center.

Figure 6:
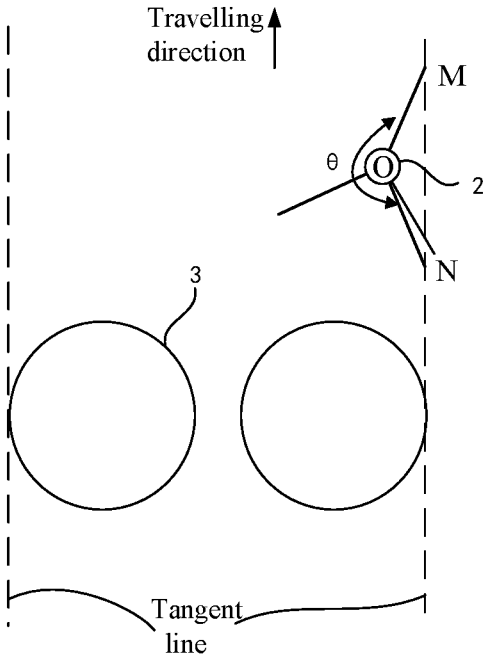
FIG. 6 is a schematic diagram of determining the reference angle threshold according to tangent lines according to an embodiment of this application.

As shown in FIG. 6, a tangent line includes a first target point M and a second target point N. A distance between the first target point M and the rotation center O of the side brush assembly and a distance between the second target point N and the rotation center O of the side brush assembly are both equal to the length L of the target bristle, and the reference angle threshold refers to an included angle θ between a third connecting line from the first target point M to the rotation center O and a fourth connecting line from the second target point N to the rotation center O.

By controlling the target included angle between two target bristles which are farthest to each other to be less than the reference angle threshold, all the target bristles can be limited to the area formed by and located between the two tangent lines of the mopping area formed by the mopping assembly along the travelling direction of the cleaning robot. When the target bristles rotate, the target bristles will not exceed outside of the designated area, and avoid to pollute the area outside of the designated area.

The inventors, through their creative endeavor, have found that in the related art, when the side brush assembly is not in work (for example, in a mopping mode), the bristles of the side brush assembly rotate with the movement of the robot, which often has adverse effects on such as external things outside the cleaning robot or the mopping assembly, the driving wheel and the like inside the cleaning robot.

For example, during the travelling process of the cleaning robot in the mopping mode, the bristles, which often exceed out of the cleaning robot, affect the appearance, thereby affecting the user experience.

Based on this, some embodiments of the present application provide a cleaning robot, which may limit a target bristle of the side brush assembly to a designated area, so as to prevent the target bristle from exceeding out of the cleaning robot as much as possible to affect the appearance.

The following describes in detail through embodiments.

In some embodiments, as shown in FIG. 1, the cleaning robot may include a robot body 1, a side brush assembly 2, and a controller.

The side brush assembly 2 is arranged on the robot body 1 and includes bristles 22. the controller is arranged on the robot body 1 and configured for controlling a target bristle of the side brush assembly to be limited in a designated area.

The designated area is a projection area of the robot body on a horizontal plane.

Figure 9:
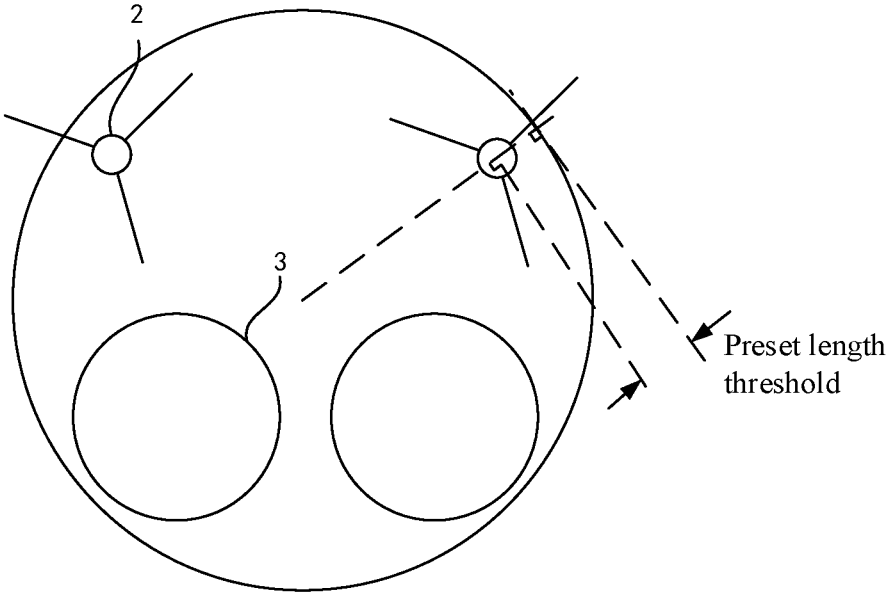
FIG. 9 is a schematic diagram showing the minimum distance between a rotation center of the side brush and an edge of the robot body according to an embodiment of this application.

The target bristle has a length greater than a preset length threshold. As shown in FIG. 9, the preset length threshold is the minimum distance between a rotation center of the side brush (i.e. rotation center of the side brush assembly) and an edge of the robot body.

It can be understood that the robot body of the cleaning robot may be circular or in another shape such as square, D-shape, etc., and the embodiments of the present application are not limited to this. Therefore, the shape of the projection area of the robot body on the horizontal plane is not limited to that shown in FIG. 9.

The side brush assembly 2 may further include an output shaft 21, and the bristles 22 are mounted on the robot body 1 by taking the output shaft 21 as a rotating shaft, and the side brush assembly is configured for sweeping the ground.

Optionally, in addition to the target bristle having a length greater than the preset length threshold, the side brush assembly may further include non-target bristles having other lengths, which is not limited in the present application.

Optionally, there may be one or more side brush assemblies 2, and the side brush assemblies 2 are spaced at a bottom or a periphery of the robot body 1. The bristles 22 included in each side brush assembly 2 may be one or more. One end of each bristle 22 is connected to the output shaft 21, and the other end of each bristle 22 is free, so that the bristles 22 can be driven to rotate with respect to the robot body 1 by taking the output shaft 21 as a rotating shaft.

When there are two or more bristles 22, the bristles 22 are distributed at intervals around the periphery of the output shaft 21, and the bristles 22 may be or may not be evenly distributed, which is not limited in the present application. When the side brush assembly 2 is in a working state, the driving device drives the bristles of the side brush assembly to rotate to realize a sweeping function.

The designated area is the projection area of the robot body on the horizontal plane. In a specific implementation, during the moving process of the cleaning robot, the target bristle of the side brush assembly may exceed out of the designated area, and may be seen by the user or may hit an obstacle to cause friction and interference. Therefore, the target bristle of the side brush assembly can be limited to be located in the designated area, which not only avoids, as much as it can, that the target bristle of the side brush assembly exceeds out of the designated area to affect the appearance, but also avoids, as much as possible, friction with the obstacle.

In some embodiments of this application, the target bristle has a length greater than a preset length threshold, and the preset length threshold is the minimum distance between the rotation center of the side brush and the edge of the robot body. The target bristle may exceed out of the designated area, and the target bristle exceeding out of the designated area during moving of the cleaning robot will affect the appearance. Therefore, the target bristle of the side brush assembly can be limited to the designated area, to avoid, as much as possible, that the target bristle exceeds out of the cleaning robot to affect the appearance.

Optionally, the cleaning robot further includes a mopping assembly, and the designated area includes a designated sub-area.

The designated sub-area is an area where an area formed by two tangent lines of a mopping area formed by the mopping assembly along a travelling direction of the cleaning robot overlaps with the designated area.

As shown in FIG. 3, the designated sub-area is the area where an area formed by the two tangent lines of the mopping area formed by the mopping assembly along the travelling direction of the cleaning robot overlaps with the designated area. In a specific implementation, during moving of the cleaning robot, the side brush assembly is in front of the mopping assembly, the area within the designated sub-area, which has been touched by the side brush assembly, can be cleaned by the mopping assembly timely. However, when the target bristle of the side brush assembly exceeds out of the designated sub-area, the area outside the designated sub-area may be polluted by the target bristle and cannot be cleaned by the mopping assembly timely. Therefore, the target bristle of the side brush assembly can be controlled to be located in the designated sub-area, so that the target bristle of the side brush assembly will not pollute the area outside the designated area, as well as not affect the appearance because of exceeding out of the projection area of the robot body on the horizontal plane.

Optionally, the designated area includes the designated sub-area, and regarding the controlling the target bristle to be limited in the designated area, the controller is configured for:

controlling the target bristle to rotate or translate to be limited in the designated area or the designated sub-area.

The target bristle is controlled to rotate or translate, so that the target bristle is limited in the designated area or in the designated sub-area. By controlling the target bristle to be located in the designated sub-area, the target bristle will neither pollute the area outside the designated area, nor exceed out of the horizontal projection area of the robot body to affect the appearance.

The side brush assembly can be rotated, so that target bristle is rotated to the designated area or the designated sub-area. In a specific implementation, after the target bristle is controlled to rotate to the designated area or the designated sub-area, the target bristle can be limited in the designated area or the designated sub-area, and no longer exceed out of the designated area or the designated sub-area. For example, the target bristle can be controlled to rotate to the designated area or the designated sub-area, and then the target bristle can be fixed in the designated area or the designated sub-area, or the target bristle is controlled to be within the designated area or the designated sub-area, and will not rotate out of the designated area or the designated sub-area.

The side brush assembly can also be controlled to translate. Specifically, the side brush assembly can be controlled to translate towards the inner side of the designated area or the designated sub-area, so that the target bristle is moved to be within the designated area or the designated sub-area.

As shown in FIG. 4, after the whole of the side brush assembly 2 moves towards the inner side of the robot body 1, the whole of the side brush assembly 2 is moved closer to a central position of the robot body 1, thus the target bristle of the side brush assembly is also moved to the designated area or the designated sub-area. The area in the designated area or the designated sub-area, which has been traversed by the bristles, can be cleaned by the mopping assembly behind, thus the risk of contamination of the cleaned area by the side brush assembly 2 due to the target bristle exceeding out of the designated sub-area is reduced, and the affect of the target bristle of the side brush assembly exceeding out of the designated sub-area on the appearance is avoided as much as it can.

Optionally, the designated area or the designated sub-area does not include where the driving wheels 4 are located.

Generally, the driving wheels 4 of the driving device are arranged at the middle position of the bottom of the robot body 1 and close to the side brush assembly 2. If the length of the bristle of the side brush assembly 2 is greater than the spacing between the side brush assembly 2 and the driving wheels 4, the bristles 22 may be pinned by the driving wheel 4 and damaged. For this purpose, in some embodiments of this application, the designated area does not include where the driving wheels 4 are located, so that the positions where the driving wheel 4 are located are excluded from the designated area, and the situation that the bristles 22 are pinned by the driving wheel 4 is avoided as much as it can.

When the side brush assembly 2 includes a plurality of bristles 22 having different lengths, the long bristle having a length greater than the preset length threshold may be taken as target bristles. As shown in FIG. 9, when the mopping assembly is in work, a mopping area is formed, and the preset length threshold may be set to be equal to the minimum distance between the rotation center of the side brush and the edge of the robot body, thereby the target bristles will not exceed out of the designated area during the travelling process of the cleaning robot. It may be understood that the target bristles having lengths greater than the preset length threshold may exceed out to an area other than the designated region, and affect the appearance, thus, the target bristles can be limited to the designated area while whether other bristles is limited in the designated area is not required.

In an embodiment of this application, when only one target bristle has a length greater than the preset length threshold, the cleaning robot can control this target bristle to be in the designated area or the designated sub-area.

When there is more than one target bristles (i.e., the bristles having lengths greater than the preset length threshold), and an included angle between two target bristles is larger, there may be a situation that one target bristle is limited to the designated area or the designated sub-area, but the other target bristle is located outside the designated area or the designated sub-area and pollutes the area outside the designated area when it is outside of the designated area or affects the appearance when it is outside of the designated sub-area. Thus, in order to alleviate the undesirable effects brought by the target bristle as much as possible, a target included angle between two target bristles which have the maximum distance therebetween (i.e., the two target bristles which are farthest to each other) may be set to be less than or equal to a reference angle threshold, so that the target bristles which have the maximum distance therebetween are both limited in the designated area or the designated sub-area, and the bristles between these two target bristles are all limited in the designated area or the designated sub-area. Therefore, during the travelling process of the cleaning robot, all target bristles will not exceed out of the designated area or the designated sub-area. In this way, the controller can control all the target bristles to be limited in the designated area or the designated sub-area at the same time.

Optionally, the number of the target bristles is at least two, and a target included angle between two target bristles having the maximum distance therebetween is less than or equal to a reference angle threshold;

the designated sub-area includes a first intersection point and a second intersection point, a distance between the first intersection point and the rotation center of the side brush assembly and a distance between the second intersection point and the rotation center of the side brush assembly are both equal to the length of the target bristle, and the reference angle threshold refers to an included angle between a first connecting line from the first intersection point to the rotation center and a second connecting line from the second intersection point to the rotation center; or the robot body includes a first contour point and a second contour point, a distance between the first contour point and the rotation center of the side brush assembly and a distance between the second contour point and the rotation center of the side brush assembly are both equal to the length of the target bristle, and the reference angle threshold refers to an included angle between a third connecting line from the first contour point to the rotation center and a fourth connecting line from the second contour point to the rotation center.

In a possible implementation, as shown in FIG. 5, the designated sub-area is an area where an area formed by two tangent lines of the mopping area formed by the mopping assembly along the travelling direction of the cleaning robot overlaps with the designated area. The designated sub-area includes a first intersection point P and a second intersection point Q. The first intersection point P is a point on a contour of the robot body, and Q is an intersection point on a tangent line. A distance between the first intersection point P and the rotation center O of the side brush assembly and a distance between the second intersection point P and the rotation center O of the side brush assembly are both equal to a length L of the target bristle. At this time, the reference angle threshold refers to the angle θ between a first connecting line from the first intersection point P to the rotation center O and a second connecting line from the second intersection point Q to the rotation center O.

By controlling the target included angle between two target bristles which are farthest to each other to be less than the reference angle threshold, all the target bristles can be limited to the designated sub-area. When the target bristles rotate, the target bristles will not exceed out of the designated sub-area, thus the target bristles can be prevented from causing pollution as much as possible, and the effect of the target bristles on the appearance can be avoided as much as possible.

Figure 10:
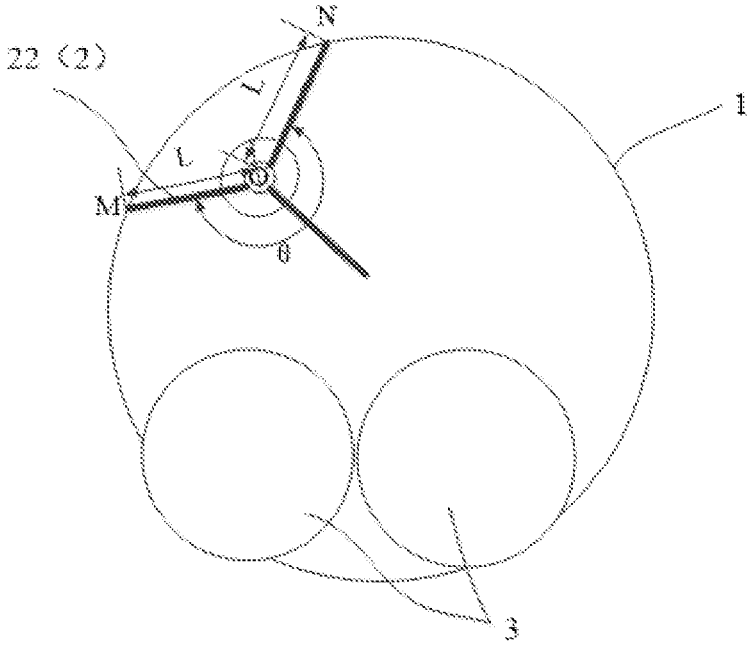
FIG. 10 is a schematic diagram showing a method for determining the reference angle threshold according to a contour of the cleaning robot and a length of a target bristle according to an embodiment of this application.

In another possible implementation, as shown in FIG. 10, the cleaning robot includes a first contour point M and a second contour point N. A distance between the first contour point M and the rotation center O of the side brush assembly and a distance between the second contour point N and the rotation center of the side brush assembly are both equal to the length L of the target bristle. At this time, the reference angle threshold refers to the angle θ between a first connecting line from the first contour point M to the rotation center O and a second connecting line from the second contour point N to the rotation center O. In this way, the reference angle threshold may be simply and quickly determined according to the contour of the cleaning robot and the length of the target bristle.

By controlling the target included angle between two target bristles which are farthest to each other to be less than the reference angle threshold, all the target bristles can be limited to be within the contour between the first contour point and the second contour point of the cleaning robot. When the bristles rotate, the bristles will not be moved to outside of the contour between the first contour point and the second contour point, thus the bristles can be prevented, as much as possible, from exceeding out of the contour between the first contour point and the second contour point to affect the appearance.

In some embodiments, regarding the controlling the target bristle to rotate to be limited in the designated area or the designated sub-area, the controller is configured for:

detecting a position of the target bristle in real time; and upon detecting that the target bristle rotates out of the designated area or the designated sub-area, controlling the target bristle to rotate to the designated area or the designated sub-area.

In implementations, as the cleaning robot moves, the target bristles may randomly rotate along with movement of the cleaning robot to exceed out of the designated area or the designated sub-area, thus the detection of the position of the target bristle can be carried out in real time, and whether the target bristle exceeds out of the designated area or the designated sub-area in the rotating process is detected. When the target bristle is detected to rotate out of the designated area or the designated sub-area, the target bristle is controlled to rotate to the designated area or the designated sub-area in real time.

In order to achieve the purpose of accurately controlling the rotation of the target bristle 22 to the designated area or the designated sub-area, some embodiments of this application further include a position detection sensor 5, and the controller is further configured for:

determining, according to a sensing signal detected by the position detection sensor 5, whether the target bristle of the side brush assembly 2 rotates out of the designated area or the designated sub-area.

In an optional embodiment, the position detection sensor 5 may be located near the side brush assembly 2 to directly detect the position of the target bristle, i.e., determine whether the target bristle enters or rotates out of a sensing area of the position detection sensor 5. Whether the bristle is limited in the designated area or the designated sub-area is determined by determining whether the target bristle enters or rotates out of the sensing area. For example, the position detection sensor 5 can be located at a position so that the target bristle is determined to be not limited in the designated area or the designated sub-area when the position detection sensor 5 detects that the target bristle enters the sensing area. Then the bristle can be controlled to rotate. Therefore, whether the target bristle is limited in the designated area or the designated sub-area can be detected in real time, when the target bristle is not in the designated area or the designated sub-area, the target bristle can be controlled to rotate to the designated area or the designated sub-area in real time, so that the target bristle does not pollute the area outside of the designated area or affect the appearance during the moving process of the cleaning robot.

Figure 7:
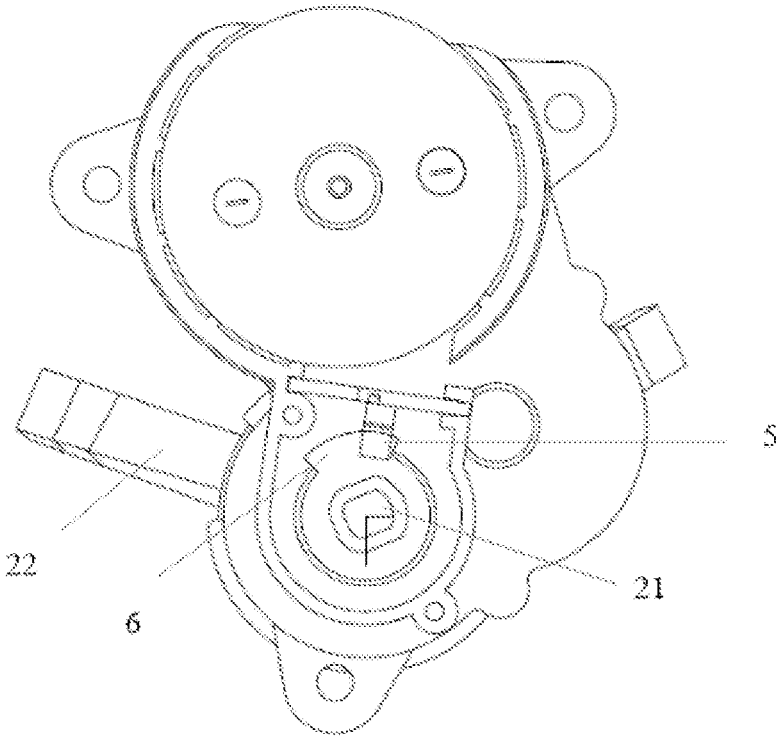
FIG. 7 is a top view of the side brush assembly according to an embodiment of this application.

In another optional embodiment, referring to FIG. 7, the cleaning robot further includes an encoding disk 6. One end of the output shaft is connected to the encoding disk 6, and the other end of the output shaft 21 is connected to the target bristle 22. The position detection sensor 5 is disposed on a side of the cleaning robot close to the encoding disk 6. The output shaft 21 is configured to drive the encoding disk 6 and the target bristle to rotate at the same time.

In some embodiments, regarding the determining, according to the sensing signal detected by the position detection sensor, whether the target bristle of the side brush assembly rotates out of the designated area or the designated sub-area, the controller is configured for:

in a process that the encoding disk and the bristles rotate simultaneously, determining, according to the sensing signal detected by the position detection sensor, position information of the encoding disk entering or rotating out of the sensing area; and determining whether the target bristle rotates out of the designated area or the designated sub-area according to the position information of the encoding disk entering or rotating out of the sensing area.

Figure 8:
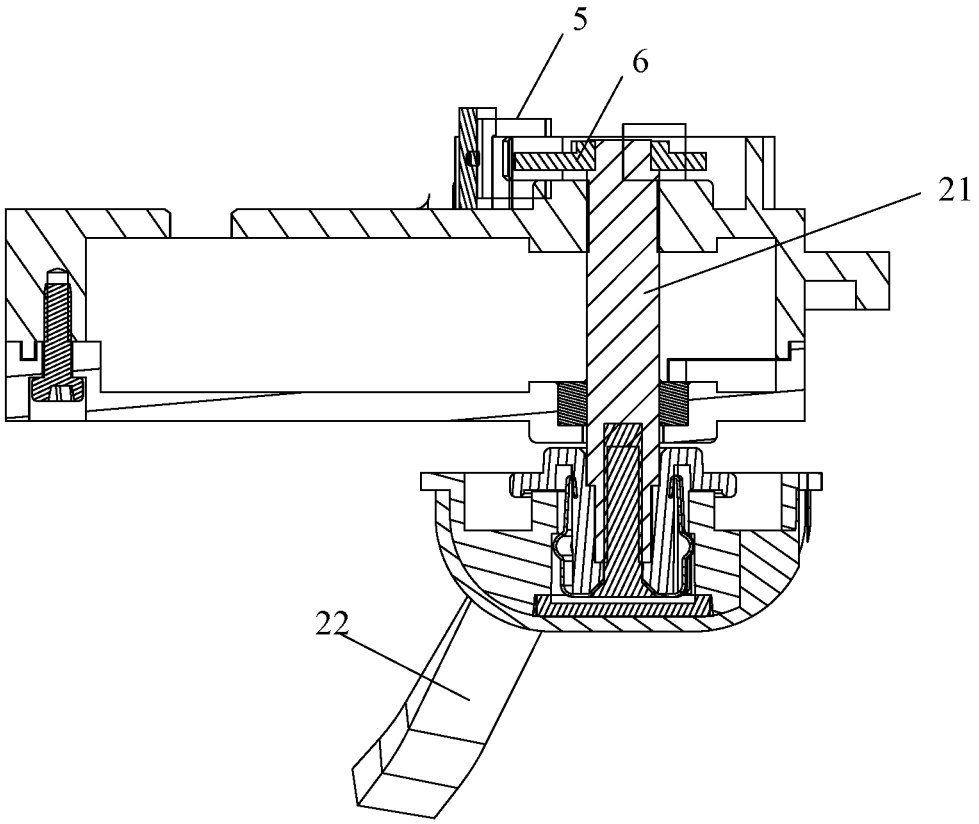
FIG. 8 is a cross-sectional view of a portion of the side brush assembly according to an embodiment of this application.

In some embodiments, referring to the top view of the side brush assembly 2 shown in FIG. 7, and the cross-sectional view of the side brush assembly 2 shown in FIG. 8, the output shaft 21 and the target bristle 22 rotate simultaneously, the output shaft 21 drives the encoding disk 6 and the target bristles 22 to rotate. During the rotation of the encoding disk 6, the encoding disk 6 will pass through the sensing area of the position detection sensor 5 to interrupt the position detection sensor 5 to detect and obtain the sensing signal. When the encoding disk 6 exits the sensing area of the position detection sensor 5, the position detection sensor 5 can detect and obtain the sensing signal again. Therefore, according to the sensing signal detected by the position detection sensor 5, the encoding disk 6 can be determined to enter or rotate out of the sensing area, and then a rotation angle of the coding disk 6 can be determined. The rotation angle can represent which position the coding disk 6 is rotated to, and then, according to the structure and the position that the side brush assembly 2 is mounted, the position of the target bristle 22, which rotates together with the coding disk 6, relative to the robot body 1 or the driving wheel 4 is determined.

In a possible implementation, the position detection sensor 5 is a U-shaped sensor.

Regarding the determining whether the target bristle rotates out of the designated area or the designated sub-area according to the position information of the encoding disk entering or rotating out of the sensing area, the controller is configured for:

in responding to that the position information indicates that the encoding disk enters the sensing area, determining that the target bristle rotates out of the designated area or the designated sub-area; or, in responding to that the position information indicates that the encoding disk rotates out of the sensing area, determining that the target bristle rotates out of the designated area or the designated sub-area.

By locating the U-shaped sensor at different positions, the above two different solutions can be implemented. In one example, the position of the U-shaped sensor can be set to make the encoding disk rotate to the sensing area of the U-shaped sensor when the target bristle rotates to other areas different from the sensing area. In this way, if the position information determined according to the sensing signal detected by the position detection sensor 5 indicates that the encoding disk 6 enters the sensing area, it can be determined that the target bristle rotates to be outside of the designated area or the designated sub-area. Then the target bristle can be controlled to rotate to the designated area or the designated sub-area, so that whether the target bristle rotates to other areas along with the movement of the cleaning robot can be detected in real time, and the target bristle rotated to other areas can be moved to the designated area or the designated sub-area in real time.

In another example, the position of the U-shaped sensor can be set to make the encoding disk rotate out of the sensing area of the U-shaped sensor when the target bristle rotates to the other areas. In this way, if the position information determined according to the sensing signal detected by the position detection sensor 5 indicates that the encoding disk 6 rotates out of the sensing area, it can be determined that the target bristle rotates to other areas other than the designated area or the designated sub-area. Then the target bristle can be controlled to rotate to the designated area or the designated sub-area, so that whether the target bristle rotates to the other areas along with the movement of the cleaning robot can be detected in real time, and the target bristle rotated to the other areas can be moved to the designated area or the designated sub-area in real time.

In this way, through the special structure of the U-shaped sensor, the difficulty of recognizing a rotation position can be effectively reduced, the calculation amount is reduced, and the calculation efficiency and accuracy are improved.

In practical application, the position detection sensor 5 may be any one of various types of sensors such as a ground penetrating sensor, a time of flight (TOF) sensor, a photoelectric sensor or a Hall sensor, which is not specifically limited in the present application.

In some embodiments, regarding the controlling the target bristle outside of the designated area to be separated from the ground, the controller is configured for:

controlling the target bristle to tilt or lift to make the target bristle outside of the designated area to be separated from the ground.

In implementations, the entire side brush assembly may be controlled to be lifted, or the target bristle may be controlled to be lifted, so that the target bristle is separated from the ground, thereby avoiding, as much as possible, that the target bristle touches the ground and pollutes the ground.

In implementations, the target bristles may be controlled to be tilted, so that when the target bristle rotates out of the designated area, the target bristle is separated from the ground, and when the target bristle rotates into the designated area, the target bristle may or may not touch the ground , which is not limited in the present application.

In some embodiments, the controller is further configured for:

controlling an orientation of the target bristle to be inconsistent with the travelling direction of the cleaning robot.

When the target bristle is controlled to be limited in the designated area or the designated sub-area, if the orientation of the target bristle is the travelling direction of the cleaning robot, friction between the bristles and the ground may be generated and damages the bristle. Therefore, the orientation of the target bristle can be controlled to be inconsistent with the travelling direction of the cleaning robot.

In implementations, the position of the target bristle may be controlled to be limited in a limiting area of the designated area or of the designated sub-area, and the limiting area is inconsistent with the travelling direction. For example, the target bristle can be controlled to rotate only in the limiting area or the designated sub-area, or the target bristle is controlled to be fixed in the limiting area and does not rotate. Alternatively, when it is detected that the target bristle rotates to the travelling direction, the target bristle is controlled to rotate to the limiting area, so that the orientation of the target bristle is inconsistent with the travelling direction of the cleaning robot on the premise that the target bristle is limited in the designated area. Thus, the bristle can be prevented, as much as possible, from being damaged by friction between the target bristle and the cleaning surface in the travelling process of the cleaning robot.

Some embodiments of the present application provide a bristle control method applied to a cleaning robot. The cleaning robot includes a side brush assembly and a mopping assembly. The method includes:

controlling a target bristle of the side brush assembly to be limited in a designated area; or, controlling a target bristle outside a designated area to be separated from the ground.

The designated area is formed by two tangent lines of a mopping area formed by the mopping assembly in a travelling direction of the cleaning robot.

The target bristle has a length greater than a preset length threshold, and the preset length threshold is the minimum distance between a rotation center of the side brush and the tangent lines.

In a specific implementation, during the movement process of the cleaning robot, the side brush assembly is located in front of the mopping assembly. The area within the designated area, which has been touched by the side brush assembly, can be cleaned by the mopping assembly timely. However, when the target bristle of the side brush assembly exceeds out of the designated area, the area outside the designated area may be polluted by the target bristle. Therefore, the target bristle of the side brush assembly can be controlled to be limited in the designated area, or the target bristle outside the designated area can be controlled to be separated from the ground, so that the target bristle of the side brush assembly is prevented, as much as possible, from exceeding out of the designated area to pollute the clean surface.

Optionally, the designated area includes a designated sub-area.

The designated sub-area is an area where the designated area overlaps with a horizontal projection area of the robot body (i.e., a projection area of the robot body on a horizontal plane).

The target bristle exceeds out of the horizontal projection area of the robot body, thus the side brush may be seen by the user, which is not attractive enough, and affects the user experience. Therefore, the target bristle can be controlled to be located in the designated sub-area, so as not to pollute the area outside the designated area, and not to exceed out of the horizontal projection area of the robot body to affect the appearance.

Optionally, the designated area includes a designated sub-area, and the controlling the target bristle of the side brush assembly to be limited in the designated area includes:

controlling the target brush to rotate or translate to be limited in the designated area or the designated sub-area.

The target bristle is controlled to rotate or translate, so that the target bristle is limited in the designated area or in the designated sub-area. By controlling the target bristle to be located in the designated sub-area, the target bristle will neither pollute the area outside the designated area, nor exceed out of the horizontal projection area of the robot body to affect the appearance.

The side brush assembly can be rotated, so that the target bristle is rotated to the designated area or the designated sub-area. In a specific implementation, after the target bristle is controlled to rotate to the designated area or the designated sub-area, the target bristle can be limited in the designated area or the designated sub-area, and no longer exceed out of the designated area or the designated sub-area. For example, the target bristle can be controlled to rotate to the designated area or the designated sub-area, and then the target bristle can be fixed in the designated area or the designated sub-area, or the target bristle is controlled to be within the designated area or the designated sub-area, and will not rotate out of the designated area or the designated sub-area.

The side brush assembly can also be controlled to translate. Specifically, the side brush assembly can be controlled to translate towards the inner side of the designated area or the designated sub-area, so that the target bristle is moved to be within the designated area or the designated sub-area.

Optionally, the designated area or the designated sub-area does not include where the driving wheels are located.

The designated area does not include where the driving wheels are located. Through excluding the positions where the driving wheel are located from the designated area, the situation that the bristles are pinned by the driving wheel is avoided as much as it can.

When the side brush assembly includes a plurality of bristles having different lengths, the long bristle having a length greater than the preset length threshold may be taken as target bristles. When the mopping assembly is in work, a mopping area is formed, and the preset length threshold may be set to be equal to the minimum distance between the rotation center of the side brush and the tangent lines, thereby the target bristles will not exceed out of the designated area during the travelling process of the cleaning robot. It may be understood that the target bristles having lengths greater than the preset length threshold may exceed out to an area other than the designated region, and cause contamination, thus, the target bristles can be limited to the designated area while whether other bristles is limited in the designated area is not required.

In an embodiment of this application, when only one target bristle has a length greater than the preset length threshold, the cleaning robot can control this target bristle to be in the designated area or the designated sub-area.

When there is more than one target bristles (i.e., the bristles having lengths greater than the preset length threshold), and an included angle between two target bristles is larger, there may be a situation that one target bristle is limited to the designated area or the designated sub-area, but the other target bristle is located outside the designated area or the designated sub-area and pollutes the area outside the designated area when it is outside of the designated area or affects the appearance when it is outside of the designated sub-area. Thus, in order to alleviate the undesirable effects brought by the target bristle as much as possible, a target included angle between two target bristles which have the maximum distance therebetween may be set to be less than or equal to a reference angle threshold, so that the target bristles which have the maximum distance therebetween are both limited in the designated area or the designated sub-area, and the bristles between these two target bristles are all limited in the designated area or the designated sub-area. Therefore, during the travelling process of the cleaning robot, all the target bristles will not exceed out of the designated area or the designated sub-area. In this way, the controller can control all the target bristles to be limited in the designated area or the designated sub-area at the same time.

Optionally, the number of the target bristles is at least two, and a target included angle between two target bristles having the maximum distance therebetween is less than or equal to a reference angle threshold.

In a possible embodiment, the designated sub-area includes a first contour point and a second contour point. A distance between the first contour point and the rotation center of the side brush assembly and a distance between the second contour point and the rotation center of the side brush assembly are both equal to the length of the target bristle, and the reference angle threshold refers to an included angle between a first connecting line from the first contour point to the rotation center and a second connecting line from the second contour point to the rotation center.

By controlling the target included angle between two target bristles which are farthest to each other to be less than the reference angle threshold, all the target bristles can be limited to the designated sub-area. When the target bristles rotate, the target bristles will not exceed out of the designated sub-area, thus the target bristles can be prevented from causing pollution as much as possible, and the effect of the target bristles on the appearance can be avoided as much as possible.

In another possible embodiment, a tangent line includes a first target point and a second target point. A distance between the first target point and the rotation center of the side brush assembly and a distance between the second target point and the rotation center of the side brush assembly are both equal to the length of the target bristle, and the reference angle threshold refers to an included angle between a third connecting line from the first target point to the rotation center and a fourth connecting line from the second target point to the rotation center.

By controlling the target included angle between two target bristles which are farthest to each other to be less than the reference angle threshold, all the target bristles can be limited to the area formed by the two tangent lines of the mopping area formed by the mopping assembly along the travelling direction of the cleaning robot. When the target bristles rotate, the target bristles will not exceed outside of the designated area, and the contamination caused by the target bristles is avoided.

Some embodiments of the present application provide a bristle control method applied to a cleaning robot. The cleaning robot includes an side brush assembly. The method includes:

controlling a target bristle of the side brush assembly to be limited in a designated area.

The designated area is a projection area of the robot body on a horizontal plane.

The target bristle has a length greater than a preset length threshold. The preset length threshold is the minimum distance between a rotation center of the side brush and an edge of the robot body.

In a specific implementation, the target bristle has a length greater than a preset length threshold, and the preset length threshold is the minimum distance between the rotation center of the side brush and the edge of the robot body. The target bristle may exceed out of the designated area which is the projection area of the robot body on the horizontal plane.

The target bristle exceeding out of the designated area during moving of the cleaning robot will affect the appearance. Therefore, the target bristle of the side brush assembly can be limited to the designated area, to avoid, as much as possible, that the target bristle exceeds out of the cleaning robot to affect the appearance.

Optionally, in addition to the target bristle having a length greater than the preset length threshold, the side brush assembly may further include non-target bristles having other lengths, which is not limited in the present application.

Optionally, the cleaning robot further includes a mopping assembly, the designated area includes a designated sub-area. The designated sub-area is an area where an area formed by two tangent lines of a mopping area formed by the mopping assembly along a travelling direction of the cleaning robot overlaps with the designated area.

The designated sub-area is the area where an area formed by the two tangent lines of the mopping area formed by the mopping assembly along the travelling direction of the cleaning robot overlaps with the designated area. In a specific implementation, during moving of the cleaning robot, the side brush assembly is in front of the mopping assembly, the area within the designated sub-area, which has been touched by the side brush assembly, can be cleaned by the mopping assembly timely. However, when the target bristle of the side brush assembly exceeds out of the designated sub-area, the area outside the designated sub-area may be polluted by the target bristle and cannot be cleaned by the mopping assembly timely. Therefore, the target bristle of the side brush assembly can be controlled to be located in the designated sub-area, so that the target bristle of the side brush assembly will not pollute the area outside the designated area, as well as not affect the appearance because of exceeding out of the projection area of the robot body on the horizontal plane.

Optionally, the designated area includes the designated sub-area, and the controlling the target bristle of the side brush assembly to be limited in the designated area includes:

controlling the target bristle to rotate or translate to be limited in the designated area or the designated sub-area.

The designated sub-area is an area where an area formed by and located between two tangent lines of the mopping area formed by the mopping assembly along the travelling direction of the cleaning robot overlaps with the designated area.

The target bristle is controlled to rotate or translate, so that the target bristle is limited in the designated area or in the designated sub-area. By controlling the target bristle to be located in the designated sub-area, the target bristle will neither pollute the area outside the designated area, nor exceed out of the projection area of the robot body on the horizontal to affect the appearance.

The side brush assembly can be rotated, so that the target bristle is rotated to the designated area or the designated sub-area. In a specific implementation, after the target bristle is controlled to rotate to the designated area or the designated sub-area, the target bristle can be limited in the designated area or the designated sub-area, and no longer exceed out of the designated area or the designated sub-area. For example, the target bristle can be controlled to rotate to the designated area or the designated sub-area, and then the target bristle can be fixed in the designated area or the designated sub-area, or the target bristle is controlled to be within the designated area or the designated sub-area, and will not rotate out of the designated area or the designated sub-area.

The side brush assembly can also be controlled to translate. Specifically, the side brush assembly can be controlled to translate towards the inner side of the designated area or the designated sub-area, so that the target bristle is moved to be within the designated area or the designated sub-area.

Optionally, the designated area or the designated sub-area does not include where the driving wheels are located.

The designated area does not include where the driving wheels are located. Through excluding the positions where the driving wheel are located from the designated area, the situation that the bristles are pinned by the driving wheel is avoided as much as it can.

When the side brush assembly includes a plurality of bristles having different lengths, the long bristle having a length greater than the preset length threshold may be taken as target bristles. When the mopping assembly is in work, a mopping area is formed, and the preset length threshold may be set to be equal to the minimum distance between the rotation center of the side brush to the edge of the robot body, thereby the target bristles will not exceed out of the designated area during the travelling process of the cleaning robot. It may be understood that the target bristles having lengths greater than the preset length threshold may exceed out to an area other than the designated region, and affect the appearance, thus, the target bristles can be limited to the designated area while whether other bristles is limited in the designated area is not required.

In an embodiment of this application, when only one target bristle has a length greater than the preset length threshold, the cleaning robot can control this target bristle to be in the designated area or the designated sub-area.

When there is more than one target bristles (i.e., the bristles having the length greater than the preset length threshold), and an included angle between two target bristles is larger, there may be a situation that one target bristle is limited to the designated area or the designated sub-area, but the other target bristle is located outside the designated area or the designated sub-area and pollutes the area outside the designated area when it is outside of the designated area or affects the appearance when it is outside of the designated sub-area. Thus, in order to alleviate the undesirable effects brought by the target bristle as much as possible, a target included angle between two target bristles which have the maximum distance therebetween may be set to be less than or equal to a reference angle threshold, so that the target bristles which have the maximum distance therebetween are both limited in the designated area or the designated sub-area, and the bristles between these two target bristles are all limited in the designated area or the designated sub-area. Therefore, during the travelling process of the cleaning robot, all the target bristles will not exceed out of the designated area or the designated sub-area. In this way, the controller can control all the target bristles to be limited in the designated area or the designated sub-area at the same time.

Optionally, the number of the target bristles is at least two, and a target included angle between two target bristles having the maximum distance therebetween is less than or equal to a reference angle threshold.

In a possible implementation, the designated sub-area includes a first intersection point and a second intersection point, a distance between the first intersection point and the rotation center of the side brush assembly and a distance between the second intersection point and the rotation center of the side brush assembly are both equal to the length of the target bristles, and the reference angle threshold refers to an included angle between a first connecting line from the first intersection point to the rotation center and a second connecting line from the second intersection point to the rotation center.

By controlling the target included angle between two target bristles which are farthest to each other to be less than the reference angle threshold, all the target bristles can be limited to the designated sub-area. When the target bristles rotate, the target bristles will not exceed out of the designated sub-area, thus the target bristles can be prevented from causing pollution as much as possible, and the effect of the target bristles on the appearance can be avoided as much as possible.

Alternatively, in another possible implementation, the robot body includes a first contour point and a second contour point, a distance between the first contour point and the rotation center of the side brush assembly and a distance between the second contour point and the rotation center of the side brush assembly are both equal to the length of the target bristle, and the reference angle threshold refers to an included angle between a third connecting line from the first contour point to the rotation center and a fourth connecting line from the second contour point to the rotation center.

By controlling the target included angle between two target bristles which are farthest to each other to be less than the reference angle threshold, all the target bristles can be limited to be within the contour between the first contour point and the second contour point of the cleaning robot. When the bristles rotate, the bristles will not be moved to outside of the contour between the first contour point and the second contour point, thus the bristles can be prevented, as much as possible, from exceeding out of the contour between the first contour point and the second contour point to affect the appearance.

In some embodiments, the controlling the target bristle to rotate to be limited in the designated area or the designated sub-area includes:

detecting a position of the target bristle in real time;

upon detecting that the target bristle rotates out of the designated area or the designated sub-area, controlling the target bristle to rotate to the designated area or the designated sub-area.

In implementations, as the cleaning robot moves, the target bristles may randomly rotate along with movement of the cleaning robot to exceed out of the designated area or the designated sub-area, thus the detection of the position of the target bristle can be carried out in real time, and whether the target bristle exceeds out of the designated area or the designated sub-area in the rotating process is detected. When the target bristle is detected to rotate out of the designated area or the designated sub-area, the target bristle is controlled to rotate to the designated area or the designated sub-area in real time.

In order to achieve the purpose of accurately controlling the rotation of the target bristle 22 to the designated area or the designated sub-area, in some embodiments, the cleaning robot may further include a position detection sensor, and the controller is further configured to determine, according to a sensing signal detected by the position detection sensor, whether the target bristle of the side brush assembly rotates out of the designated area or the designated sub-area.

Optionally, the position detection sensor may be located near the side brush assembly to directly detect the position of the target bristle, i.e., determine whether the target bristle enters or rotates out of a sensing area of the position detection sensor. Whether the bristle is limited in the designated area or the designated sub-area is determined by determining whether the target bristle enters or rotates out of the sensing area. For example, the position detection sensor can be located at a position so that the target bristle is determined to be not limited in the designated area or the designated sub-area when the position detection sensor detects that the target bristle enters the sensing area. Then the bristle can be controlled to rotate. Therefore, whether the target bristle is limited in the designated area or the designated sub-area can be detected in real time, when the target bristle is not in the designated area or the designated sub-area, the target bristle can be controlled to rotate to the designated area or the designated sub-area in real time, so that the target bristle does not pollute the area outside of the designated area or affect the appearance during the moving process of the cleaning robot.

Optionally, the cleaning robot further includes an encoding disk. One end of the output shaft is connected to the encoding disk, and the other end of the output shaft is connected to the target bristle. The position detection sensor is disposed on a side of the cleaning robot close to the encoding disk. The output shaft is configured to drive the encoding disk and the target bristle to rotate at the same time.

In some embodiments, the determining, according to the sensing signal detected by the position detection sensor, whether the target bristle of the side brush assembly rotates out of the designated area or the designated sub-area includes:

in a process that the encoding disk and the bristles rotate simultaneously, determining, according to the sensing signal detected by the position detection sensor, position information of the encoding disk entering or rotating out of the sensing area; and determining whether the target bristle rotates out of the designated area or the designated sub-area according to the position information of the encoding disk entering or rotating out of the sensing area.

In some embodiments, the output shaft and the target bristle rotate simultaneously, the output shaft drives the encoding disk and the target bristles to rotate. During the rotation of the encoding disk, the encoding disk will pass through the sensing area of the position detection sensor to interrupt the position detection sensor to detect and obtain the sensing signal. When the encoding disk exits the sensing area of the position detection sensor, the position detection sensor can detect and obtain the sensing signal again. Therefore, according to the sensing signal detected by the position detection sensor, the encoding disk can be determined to enter or rotate out of the sensing area, and then a rotation angle of the coding disk can be determined. The rotation angle can represent which position the coding disk is rotated to, and then, according to the structure and the position that the side brush assembly is mounted, the position of the target bristle, which rotates together with the coding disk, relative to the robot body or the driving wheel is determined.

Optionally, the position detection sensor is a U-shaped sensor.

In some embodiments, the determining whether the target bristle rotates out of the designated area or the designated sub-area according to the position information of the encoding disk entering or rotating out of the sensing area includes:

in responding to that the position information indicates that the encoding disk enters the sensing area, determining that the target bristle rotates out of the designated area or the designated sub-area; or, in responding to that the position information indicates that the encoding disk rotates out of the sensing area, determining that the target bristle rotates out of the designated area or the designated sub-area.

By locating the U-shaped sensor at different positions, the above two different solutions can be implemented. In one example, the position of the U-shaped sensor can be set to make the encoding disk rotate to the sensing area of the U-shaped sensor when the target bristle rotates to other areas different from the sensing area. In this way, if the position information determined according to the sensing signal detected by the position detection sensor indicates that the encoding disk enters the sensing area, it can be determined that the target bristle rotates to be outside of the designated area or the designated sub-area. Then the target bristle can be controlled to rotate to the designated area or the designated sub-area, so that whether the target bristle rotates to the other areas along with the movement of the cleaning robot can be detected in real time, and the target bristle rotated to the other areas can be moved to the designated area or the designated sub-area in real time.

In another example, the position of the U-shaped sensor can be set to make the encoding disk rotate out of the sensing area of the U-shaped sensor when the target bristle rotates to the other areas. In this way, if the position information determined according to the sensing signal detected by the position detection sensor indicates that the encoding disk rotates out of the sensing area, it can be determined that the target bristle rotates to other areas other than the designated area or the designated sub-area. Then the target bristle can be controlled to rotate to the designated area or the designated sub-area, so that whether the target bristle rotates to the other areas along with the movement of the cleaning robot can be detected in real time, and the target bristle rotated to the other areas can be moved to the designated area or the designated sub-area in real time.

In this way, through the special structure of the U-shaped sensor, the difficulty of recognizing a rotation position can be effectively reduced, the calculation amount is reduced, and the calculation efficiency and accuracy are improved.

In practical application, the position detection sensor may be any one of various types of sensors such as a ground penetrating sensor, a time of flight (TOF) sensor, a photoelectric sensor or a Hall sensor, which is not specifically limited in the present application.

In some embodiments, the controlling the target bristle outside of the designated area to be separated from the ground includes:

controlling the target bristle to tilt or lift to make the target bristle outside of the designated area to be separated from the ground.

In implementations, the entire side brush assembly may be controlled to be lifted, or the target bristle may be controlled to be lifted, so that the target bristle is separated from the ground, thereby avoiding, as much as possible, that the target bristle touches the ground and pollutes the ground.

In implementations, the target bristles may be controlled to be tilted, so that when the target bristle rotates out of the designated area, the target bristle is moved separated from the ground, and when the target bristle rotates into the designated area, the target bristle may or may not touch the ground , which is not limited in the present application.

In some embodiments, the method further includes:

controlling an orientation of the target bristle to be inconsistent with the travelling direction of the cleaning robot.

When the target bristle is controlled to be limited in the designated area or the designated sub-area, if the orientation of the target bristle is the travelling direction of the cleaning robot, friction between the bristles and the ground may be generated and damages the bristle. Therefore, the orientation of the target bristle can be controlled to be inconsistent with the travelling direction of the cleaning robot.

In implementations, the position of the target bristle may be controlled to be limited in a limiting area of the designated area or of the designated sub-area, and the limiting area is inconsistent with the travelling direction. For example, the target bristle can be controlled to rotate only in the limiting area, or the target bristle is controlled to be fixed in the limiting area and does not rotate. Alternatively, when it is detected that the target bristle rotates to the travelling direction, the target bristle is controlled to rotate to the limiting area, so that the orientation of the target bristle is inconsistent with the travelling direction of the cleaning robot on the premise that the target bristle is limited in the designated area. Thus, the bristle can be prevented, as much as possible, from being damaged by friction between the target bristle and the cleaning surface in the travelling process of the cleaning robot.

Some embodiments of the present application provide a bristle control device, which is applied to any one of the above-mentioned cleaning robots. The cleaning robot includes an side brush assembly, and the bristle control device includes:

a controller configured for:

controlling a target bristle of the side brush assembly to be limited in a designated area; or, controlling a target bristle outside a designated area to be separated from the ground.

The designated area is formed by and located between two tangent lines of a mopping area formed by a mopping assembly along a travelling direction of the cleaning robot.

The target bristle has a length greater than a preset length threshold, and the preset length threshold is the minimum distance between a rotation center of the side brush and the tangent lines.

Alternatively, the designated area is a projection area of the robot body on a horizontal plane, and the target bristle has a length greater than a preset length threshold, and the preset length threshold is the minimum distance from a rotation center of the side brush to an edge of the robot body.

Some embodiment of the present application provides a computer readable storage medium. At least one instruction is stored in the storage medium, and the instruction is loaded and executed by a processor to implement the bristle control method provided in the embodiments of this application.

A person of ordinary skill in the art may understand that all or some of the steps of implementing the above embodiments may be carried out by hardware, or may be carried out by a program instructing related hardware, and the program may be stored in a computer-readable storage medium, and the above-mentioned storage medium may be a read-only memory, a magnetic disk, or an optical disk.

Although the present application has been described in detail with reference to the foregoing embodiments, it should be understood by those of ordinary skill in the art that they may still modify the technical solutions described in the foregoing embodiments, or equivalently replace some of the technical features. These modifications or substitutions do not depart from the spirit and scope of the technical solutions of the embodiments of this application.

What is claimed is:

1. A cleaning robot, comprising:

a robot body;

a side brush assembly and a mopping assembly disposed on the robot body;

a controller disposed on the robot body and configured for:

controlling a target bristle of the side brush assembly to be limited in a designated area; or controlling a target bristle outside a designated area to be separated from a ground, wherein the designated area is an area formed by two tangent lines of a mopping area formed by the mopping assembly along a travelling direction of the cleaning robot, wherein the target bristle has a length greater than a preset length threshold, and the preset length threshold is a minimum distance between a rotation center of the side brush and the two tangent lines.

2. The cleaning robot according to claim 1, wherein the designated area comprises a designated sub-area, and the designated sub-area is an area where the designated area overlaps with a projection area of the robot body on a horizontal plane.

3. The cleaning robot according to claim 2, wherein regarding the controlling the target bristle of the side brush assembly to be limited in the designated area, the controller is configured for:

controlling the target bristle to rotate or translate to be limited in the designated sub-area.

4. The cleaning robot according to claim 3, wherein regarding the controlling the target bristle to rotate to be limited in the designated sub-area, the controller is configured for:

detecting a position of the target bristle in real time; and upon detecting that the target bristle rotates out of the designated sub area, controlling the target bristle to rotate to the designated sub-area.

5. The cleaning robot according to claim 4, further comprising a position detection sensor, wherein the controller is further configured for:

determining, according to a sensing signal detected by the position detection sensor, whether the target bristle of the side brush assembly rotates out of the designated sub-area.

6. The cleaning robot according to claim 5, further comprising an output shaft and an encoding disk, wherein:

one end of the output shaft is connected to the encoding disk, and another end of the output shaft is connected to the target bristle, the position detection sensor is arranged on a side of the cleaning robot close to the encoding disk, and the output shaft is configured for driving the encoding disk and the target bristle to rotate simultaneously;

regarding the determining, according to the sensing signal detected by the position detection sensor, whether the target bristle of the side brush assembly rotates out of the designated sub-area, the controller is configured for:

in a process that the encoding disk and the target bristle rotate simultaneously, determining, according to the sensing signal detected by the position detection sensor, position information of the encoding disk entering or rotating out of a sensing area; and determining whether the target bristle rotates out of the designated sub-area according to the position information of the encoding disk entering or rotating out of the sensing area.

7. The cleaning robot according to claim 6, wherein the position detection sensor is a U-shaped sensor; and regarding the determining whether the target bristle rotates out of the designated sub-area according to the position information of the encoding disk entering or rotating out of the sensing area, the controller is configured for:

in responding to that the position information indicates that the encoding disk enters the sensing area, determining that the target bristle rotates out of the designated sub-area; or in responding to that the position information indicates that the encoding disk rotates out of the sensing area, determining that the target bristle rotates out of the designated sub-area.

8. The cleaning robot according to claim 2, wherein:

the side brush assembly comprises at least two target bristles, and a target included angle between two target bristles which are farthest to each other is less than or equal to a reference angle threshold; and the designated sub-area comprises a first contour point and a second contour point, a distance between the first contour point and the rotation center of the side brush assembly and a distance between the second contour point and the rotation center of the side brush assembly are both equal to a length of the target bristle, and the reference angle threshold refers to an included angle between a first connecting line from the first contour point to the rotation center and a second connecting line from the second contour point to the rotation center; or the tangent line comprises a first target point and a second target point, a distance between the first target point and the rotation center of the side brush assembly and a distance between the second target point and the rotation center of the side brush assembly are both equal to a length of the target bristle, and the reference angle threshold refers to an included angle between a third connecting line from the first target point to the rotation center and a fourth connecting line from the second target point to the rotation center.

9. The cleaning robot according to claim 1, wherein regarding the controlling the target bristle of the side brush assembly to be limited in the designated area, the controller is configured for:

controlling the target bristle to rotate or translate to be limited in the designated area.

10. The cleaning robot according to claim 9, wherein regarding the controlling the target bristle to rotate to be limited in the designated area, the controller is configured for:

detecting a position of the target bristle in real time; and upon detecting that the target bristle rotates out of the designated area, controlling the target bristle to rotate to the designated area.

11. The cleaning robot according to claim 10, further comprising a position detection sensor, wherein the controller is further configured for:

determining, according to a sensing signal detected by the position detection sensor, whether the target bristle of the side brush assembly rotates out of the designated area.

12. The cleaning robot according to claim 11, further comprising an output shaft and an encoding disk, wherein:

one end of the output shaft is connected to the encoding disk, and another end of the output shaft is connected to the target bristle, the position detection sensor is arranged on a side of the cleaning robot close to the encoding disk, and the output shaft is configured for driving the encoding disk and the target bristle to rotate simultaneously;

regarding the determining, according to the sensing signal detected by the position detection sensor, whether the target bristle of the side brush assembly rotates out of the designated area, the controller is configured for:

in a process that the encoding disk and the target bristle rotate simultaneously, determining, according to the sensing signal detected by the position detection sensor, position information of the encoding disk entering or rotating out of a sensing area; and determining whether the target bristle rotates out of the designated area according to the position information of the encoding disk entering or rotating out of the sensing area.

13. The cleaning robot according to claim 12, wherein the position detection sensor is a U-shaped sensor; and regarding the determining whether the target bristle rotates out of the designated area according to the position information of the encoding disk entering or rotating out of the sensing area, the controller is configured for:

in responding to that the position information indicates that the encoding disk enters the sensing area, determining that the target bristle rotates out of the designated area; or in responding to that the position information indicates that the encoding disk rotates out of the sensing area, determining that the target bristle rotates out of the designated area.

14. The cleaning robot according to claim 1, wherein regarding the controlling the target bristle outside of the designated area to be separated from the ground, the controller is configured for:

controlling the target bristle to tilt or lift to make the target bristle outside of the designated area to be separated from the ground.

15. The cleaning robot according to claim 1, wherein the controller is further configured for:

controlling an orientation of the target bristle to be inconsistent with a travelling direction of the cleaning robot.

16. A bristle control method applied to a cleaning robot, wherein the cleaning robot comprises a robot body; and a side brush assembly, a mopping assembly, and a controller which are all disposed on the robot body, and the method comprises:

controlling a target bristle of the side brush assembly to be limited in a designated area; or controlling the target bristle outside the designated area to be separated from the ground, wherein the designated area is an area formed by two tangent lines of a mopping area formed by the mopping assembly along a travelling direction of the cleaning robot, wherein the target bristle has a length greater than a preset length threshold, and the preset length threshold is a minimum distance between a rotation center of the side brush and the two tangent lines.

17. A computer-readable storage medium comprising instructions that, when executed by a computer, cause the computer to execute a bristle control method, wherein the bristle control method is applied to a cleaning robot, the cleaning robot comprises a robot body; and a side brush assembly, a mopping assembly, and a controller which are all disposed on the robot body, and the method comprises:

controlling a target bristle of the side brush assembly to be limited in a designated area; or controlling the target bristle outside the designated area to be separated from the ground, wherein the designated area is an area formed by two tangent lines of a mopping area formed by the mopping assembly along a travelling direction of the cleaning robot, wherein the target bristle has a length greater than a preset length threshold, and the preset length threshold is a minimum distance between a rotation center of the side brush and the two tangent lines.

* * * * *